United States Patent [19]

Stoev et al.

[11] 4,240,903

[45] Dec. 23, 1980

[54] METHOD OF REVERSE STRATIFICATION

[75] Inventors: Stoycho M. Stoev; Shtilyana D. Djendova; Metodi S. Metodiev; Kalinka I. Kresteva, all of Sofia, Bulgaria

[73] Assignee: Vish Minno Geoloshki Institute, Sofia, Bulgaria

[21] Appl. No.: 926,666

[22] Filed: Jul. 21, 1978

Related U.S. Application Data

[63] Continuation-in-part of Ser. No. 799,783, May 23, 1977, abandoned.

[30] Foreign Application Priority Data

May 21, 1976 [BG] Bulgaria ..... 33263

[51] Int. Cl.[3] ..... B03B 5/48

[52] U.S. Cl. ..... 209/437; 209/504

[58] Field of Search ..... 209/437, 446, 447, 504, 209/211

[56] References Cited

U.S. PATENT DOCUMENTS

| | | | |
|---|---|---|---|
| 551,826 | 12/1895 | Nuselton | 209/437 X |
| 594,827 | 11/1897 | Rouse | 209/443 |
| 1,049,217 | 12/1912 | Fasting | 209/504 X |
| 1,482,607 | 2/1924 | Gow | 209/504 |
| 1,704,265 | 3/1929 | Stephan | 209/443 |
| 2,615,572 | 10/1952 | Hodge | 209/211 |
| 4,059,506 | 11/1977 | Bryson | 209/211 X |

FOREIGN PATENT DOCUMENTS

| | | | |
|---|---|---|---|
| 598276 | 9/1925 | France | 209/504 |

OTHER PUBLICATIONS

Taggart, Handbook of Mineral Dressing, Mar. 1947, 11-03, 11-55,56.

*Primary Examiner*—Robert Halper

[57] ABSTRACT

A method of reverse stratification of solid particulate material, in which heavy particles move upwards and lighter particles move downwards. The material intended for stratification is supplied as a water-solids mixture moving at the bottom of a vessel. The material is submitted to vibration so that the quantity of material intended for stratification with respect to the quantity of water is in the ratio of 1:0.2 to 1:0.5 by weight.

6 Claims, 1 Drawing Figure

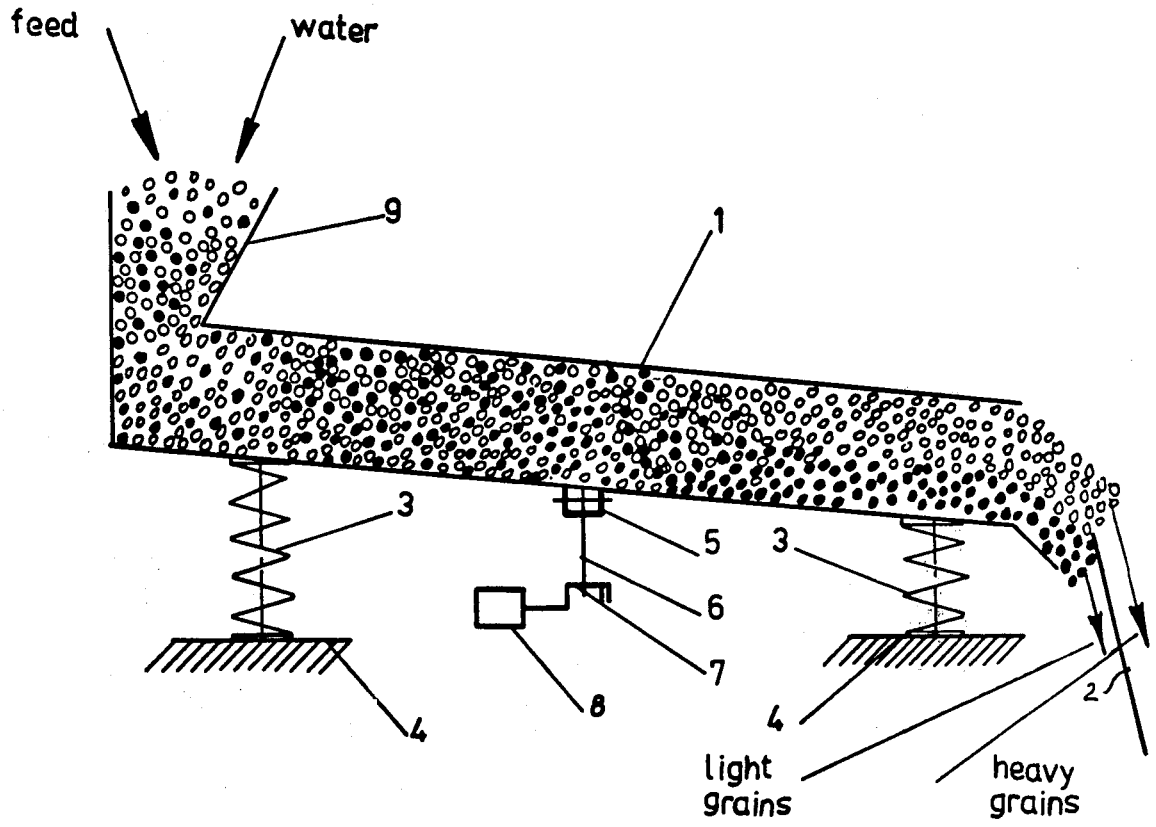
feed
water
9
1
3
5
3
6
7
8
4
4
2
light grains
heavy grains

METHOD OF REVERSE STRATIFICATION

This application is a continuation-in-part of application Ser. No. 799,783 filed May 23, 1977, now abandoned.

This invention relates to a method of reverse stratification which is useful, for example, in the field of preparation of coal and other non-ore fossil materials. By "reverse stratification" is meant the movement of heavy particles upwards and the movement of lighter particles downwards.

There is a well-known method of reverse stratification, wherein to eliminate the harmful effect of water turbulence, the process is carried out with a water-to-solids ration of 2:1 i.e. with a considerable depth of the water layer above the solid material. The large amount of water, which must be thereafter separated from the final products, requires the use of sophisticated dehydration equipment and hydro-slime facilities, which is economically disadvantageous and greatly contributes to the pollution of water sources.

The object of this invention is to eliminate the use of large amounts of technological water, using such quantities which would appear proper to fill the inter-granular spaces without forming a deep layer above the solid raw materials.

This object is attained by providing a method of reverse stratification, wherein the materials to be stratified are fed as a water solid material mixture moving at the bottom of a vessel and submitted to vibration wherein the ratio of the material to be stratified with respect to water is in the ratio range of 1:0.2 to 1:0.5 by weight.

The advantages of the method of the invention are that the sepration of the solid material depending upon its density and the size of its particles is achieved with small amounts of water, so that considerable water-savings are obtained, and, on the other hand, the necessity of sophisticated dehydration equipment and slime/or slurry water management is avoided; slurry-pollution of the water sources is also avoided.

Briefly, the essence of the reverse-stratification method according to this invention is as follows:

The material to be stratified is fed, together with water in a quantity sufficient to form only water interlayers. Such interlayers, when the water-solid material mixture is vibrated are uniformaly distributed along the whole of the raw-material, thus performing the function of the lubricant. This in turn facilitates the movement of the heavy particles upwards and the downward movement of the lighter particles. The small amount of water utterly eliminates the formation of active turbulent eddies or whirls which would otherwise be able to impair the reverse stratification-process, directing it towards normal stratification in which the heavier particles travel downwardly and the lighter particles travel upwardly.

The invention will be more readily understood by reference to the accompanying drawing, in which:

The single FIGURE of the drawing is a schematic view in longitudinal vertical axial section through an apparatus for carrying out the method of the invention.

Turning now to the drawing, there is there shown a vessel in the form of a trough 1, a mixture of rock and coal grains being fed into the feeding inlet 9 at the left-hand end thereof as shown. The grains may for example have particles size of from 10 to 0.5 mm. The trough is vibrated vertically in the following manner. The trough 1 is mounted for vertical movement on coil compression springs 3 disposed on a fixed frame or foundation 4 near the opposite ends of the trough. A motor 8 rotates an eccentric 7 the crank of which is connected by a connecting rod 6 to a pivotal connecting means 5 affixed to the trough 1 intermediate the length thereof. When the trough moves upwardly, all of the grains, being in mechanical contact with each other, have the same vibrational acceleration as that of the dense bottom of the trough. But the mass of the coal grains is considerably smaller than that of the rock grains, for they have a different volume density. As is well known, the product of the mass by its acceleration gives the force. Hence, when the trough begins moving downwardly, the rock grains will have an inertia force greater than that of the coal grains. This allows the rock grains to move upwards more easily, overcoming a resistance, thus progressively grains thereof gather and form a product lying above the coal grains, which thus occupy the place formerly occupied by the grains of rock which have been thrown upwardly. Hence, there is a separation of the grains according to their volume density, which does not exist in any of the machines known until now for gravity preparation of particulate material. If the grains are dry, this process is comparatively slow and not sufficiently selective. This results from the high frictional forces which exist between the dry grains. Such friction can be reduced if some water is introduced into the trough, but there are certain restrictions as to the quantity of water to be thus introduced.

If the water is introduced in such quantity that turbulences appear in the space between the grains and above them, the process is disturbed and proceeds either unselectively, or the coal grains rise upwardly and the rock grains remain at the bottom, i.e., as in existing machines. In accordance with the invention the turbulence is removed in two ways. First, by feeding water, which forms a rather thick layer on the coal. In this case the turbulence takes place in the upper zone of the water and dives away in a downward direction toward the coal-rock layer. Such method, however, requires great quantities of water and rather unpredictable. The second method, which is in accordance with the present invention, is economically advantageous and much more selective. In accordance with such method, the water is fed in a quantity which is only necessary to coat the grains. Thus the water is fed into the trough to a level which is much below the upper level of the coal-rock composite layer while the trough is not vibrating. When the trough begins vibrating, this water is thrown upwardly, thus coating the grains and performs the function of a lubricator between adjacent grains without giving rise to any harmful turbulence. This is why the process in the present invention proceeds with a flow of water which is five to 20 times lower than that employed in all prior processes of the wet preparation of particulate material.

The method in accordance with the invention thus requires the following condition for its practice:

1. A vibration with low frequency (five to thirty Hertz) and a high amplitude (from three to 15 mm).

2. The addition of water to the coal-rock composite layer in the trough which is necessary only to coat the grains.

3. Vibration of the trough in a linear direction, that is vertical or one which is biased forwardly to only a small extent (circular vibrations mix the product and are thus not suitable).

The method in accordance with the invention is highly efficient when employed with grains of from 1 to 20 mm, although smaller material as well as larger ones can be divided or stratified in the same way, less efficiently.

The method in accordance with the invention is characterized by the extremely low expense it entails in its practice. Other advantages over the prior art are a two to three times greater productivity, the consumption of about ⅓ the power, and the easy control of the material preparation. The method can be carried out in a simple machine such as that shown in the drawing. In the apparatus shown in the drawing the trough is inclined downwardly from left to right, and the line of vibration is vertical; the particulate material is thus transported along the trough in a direction from left to right. As shown, the vibration is linear. If the trough is horizontal, the line of linear vibration can then be biased or inclined with respect to the horizontal so as to feed the particulate material from left to right.

The particulate material is fed with the necessary quantity of water to the trough, which is supported on springs, and is vibrated under the influence of a vibrator such as an eccentric or an inertial vibrator. As above explained, the material is stratified in such a way that the heavy grains gather above the light product which remains at the bottom of the trough. The light product can be separated from the heavy product at the right-hand, discharge end of the trough by a splitter plate 2 as shown, following which the thus separated light and heavy products are forwarded along separated paths by separate means for further processing.

EXAMPLE

As an example of the application of the reverse-stratification method of the invention, there can be cited the preparation of coal particles sized from 10 to 0.5 mm, having a depth of the layer of 160 mm. The stratification is carried out with a solid-to-water ratio of 1:0.25 by weight taking 16 seconds for at an efficiency of separation reaching 97%.

The process is highly efficient with a great separating ability and requires a water-flow about 8 times less than the above-described known reverse-stratification method, and about 16 times less than with machines employing gravitational preparation. The method of reverse-stratification of the invention can be carried out in through-type vibration machines, linearly, vertically or small-bias vibrated wit parameters sufficient to generate a vibration which overcomes the resistance to reverse of the stratification of the solid material particles.

Although the invention is illustrated and described with reference to one preferred embodiment thereof, it is to be expressly understood that it is in no way limited to the disclosure of such a preferred embodiment, but is capable of numerous modifications within the scope of the appended claims.

What is claimed is:

1. A method of reverse stratification of solid particulate material containing lighter and heavier particles, which comprises forming a solid material-water mixture wherein the water is present in an amount which is necessary only to coat the particles, passing said mixture along the bottom of an inclined container from the entrance end to the exit end thereof, the bottom of the container lying in one plane, and subjecting the said mixture as it passes through the container to linear vertical vibration, whereby the heavier particles rise in said mixture and the lighter particles sink in said mixture, and discharging in discrete layers along separate paths all of the stratified material from the exit end of the container, the weight of the solid material relative to the weight of the water lies in the range of 1:0.2 to 1:0.5.

2. A method in accordance with claim 1, wherein the solid material has a particle size from 1–20 mm.

3. A method in accordance with claim 1, wherein the solid material has a particle size from 0.5–10 mm.

4. A method in accordance with claim 1, wherein the linear vertical vibration has a frequency of from 5–30 Herz.

5. A method in accordance with claim 4, wherein the linear vertical vibration has an amplitude of from 3–15 mm.

6. A method in accordance with claim 1, wherein the linear vertical vibration is forwardly biased whereby to feed the mixture along the bottom of the container.

* * * * *